US005956854A

United States Patent [19]

Lorocco

[11] Patent Number: 5,956,854

[45] Date of Patent: Sep. 28, 1999

[54] DAY/NIGHT WEAPON SIGHT

[75] Inventor: Paul M. Lorocco, Dallas, Tex.

[73] Assignee: Tru-Glo, Inc., Dallas, Tex.

[21] Appl. No.: 08/780,175

[22] Filed: Dec. 26, 1996

[51] Int. Cl.[6] ..... F41G 1/32

[52] U.S. Cl. ..... 33/241; 33/233

[58] Field of Search ..... 33/241, 265; 385/18; 156/85

[56] References Cited

U.S. PATENT DOCUMENTS

| | | | |
|---|---|---|---|
| 837,563 | 12/1906 | Hartman . | |
| 2,610,405 | 9/1952 | Dickson | 33/47 |
| 2,706,335 | 4/1955 | Munsey | 33/47 |
| 3,098,303 | 7/1963 | Plisk | 33/52 |
| 3,578,973 | 5/1971 | Dooley et al. | 250/467 |
| 3,949,482 | 4/1976 | Ross | 33/241 |
| 4,030,203 | 6/1977 | Ackerman, Jr. | 33/241 |
| 4,070,763 | 1/1978 | Carts, Jr. | 33/241 |
| 4,422,719 | 12/1983 | Orcutt | 350/96.3 |
| 4,743,765 | 5/1988 | Ekstrand | 250/467.1 |
| 4,806,007 | 2/1989 | Bindon | 359/424 |
| 4,918,823 | 4/1990 | Santiago | 33/241 |
| 4,928,394 | 5/1990 | Sherman | 33/265 |
| 4,945,667 | 8/1990 | Rogalski | 42/100 |
| 4,993,158 | 2/1991 | Santiago | 33/253 |
| 5,001,837 | 3/1991 | Bray | 33/265 |
| 5,065,519 | 11/1991 | Bindon | 33/241 |
| 5,121,462 | 6/1992 | Fabre et al. | 385/143 |
| 5,168,540 | 12/1992 | Winn et al. | 385/128 |
| 5,168,631 | 12/1992 | Sherman | 33/265 |
| 5,201,124 | 4/1993 | Sherman | 33/265 |
| 5,291,577 | 3/1994 | Zoscak | 385/147 |
| 5,292,577 | 3/1994 | Zoscak | 385/147 |
| 5,442,861 | 8/1995 | LoRocco | 33/241 |
| 5,638,604 | 6/1997 | LoRocco | 33/241 |
| 5,653,034 | 8/1997 | Bindon | 33/241 |

FOREIGN PATENT DOCUMENTS

| | | | |
|---|---|---|---|
| 128753 | 1/1984 | European Pat. Off. . | |
| 470016 | 2/1992 | European Pat. Off. | 33/241 |
| 3813258 | 11/1989 | Germany | 385/147 |
| 4214997 | 11/1993 | Germany . | |
| 53-31399 | 3/1978 | Japan . | |
| 211702 | 8/1989 | Japan | 385/147 |

OTHER PUBLICATIONS

Riedel–deHaën; Technical Bulletin "Lumilux® N–pigments," Germany, Mar. 1994.

Sales brochure, "Truglo Archery Products" Truglo Archery Products, 1995.

Sales brochure, "Truglo When Brightness Countes," Truglo Archery Products, 1996.

Stanislawski Archery Products, Mar. 4, 1991, "Stanislawski Archery Products Producing Winning Results".

Golden Key & Photo's—"Glow–Sight", p. 10 (dates unknown).

Photos of alleged prior products—"Prior One", "Prior Two", "Prior Three", and "Prior Four" (dates unknown).

*Primary Examiner*—Charles T. Jordan
*Assistant Examiner*—Denise J. Buckley
*Attorney, Agent, or Firm*—Jenkens & Gilchrist, A Professional Corporation

[57] ABSTRACT

A phosphorescent or light-reflective member is disposed on a holder supporting an elongated light-gathering optical fiber formed of a light-gathering fluorescent plastic material. The sight is adaptable for use on rifles, handguns, bows, and other weapons requiring an aiming indicia. The light-gathering fluorescent optical provides a brilliant dot that is readily identifiable under bright light conditions, and the phosphorescent or light-reflecting member provides a supplemental light source which serves to provide an illuminated dot under low-light or dark conditions. The sight 10 effectively solves the problem of providing electrically-powered light sources for illumination of the aiming indicia under low light or dark conditions, or the requirement to precisely align the fiber or hollow tube with a light source disposed at the distal end of the fiber or tube spaced from the viewing end of the fiber or tube.

10 Claims, 5 Drawing Sheets

DAY/NIGHT WEAPON SIGHT

BACKGROUND OF THE INVENTION

1. Technical Field

This invention relates generally to sights for hand-held weapons such as rifles, pistols and bows, and more particularly to such sights having a means for illuminating the sight in low-light and dark conditions.

2. History of Related Art

Many attempts have been made to provide a sight for guns and bows that is usable under daylight, low light, and night conditions. One attempt to provide an aiming sight usable under both day and night conditions is disclosed in U.S. Pat. No. 4,070,763 issued Jan. 31, 1978, to Stanley L. Carts, Jr. The Carts sight proposes the use of hollow light-absorbing fibers, or solid fibers having a transparent core, that are coated with a light-absorbing material, such as black glass, to keep light contained within the fiber. A small dot is observable only when the axis of the fiber is aligned within one milliradian of a line from the user's eye to the radiation source. This requirement makes the sight difficult to use because of the time that may be required to "find" the dot source and then align the weapon with the target without losing sight of the dot.

The use of light-gathering fluorescent fibers in a bow sight is disclosed in U.S. Pat. No. 5,442,861 issued Aug. 22, 1995, to Paul M. LoRocco, the inventor of the present invention. In his earlier invention, Mr. LoRocco discovered that the use of light-gathering fluorescent fibers dramatically increased the amount of light emitted from an end of the fiber, in both daylight and low light conditions. More recently, several arrangements for adapting light-gathering fluorescent fibers to a variety of weapon sights is disclosed in the present inventor's co-pending U.S. patent application No. 08/506,722, filed Jul. 26, 1995, now U.S. Pat. No. 5,638,604. However, in both of the above-disclosed sight arrangements, if a natural light source is not available, such as under nighttime conditions, the end of the fiber is not noticeably visible.

Attempts to provide a weapon sight suitable for use under both daylight and nighttime conditions include reticles illuminated by an artificial light source, such as a small incandescent bulb, and light-emitting diodes. These arrangements require a source of electrical power such as batteries, rendering the device cumbersome and susceptible to failure if the electrical power source is interrupted. Other attempts to provide a weapon sight for use under day or night conditions includes the use of small phosphorescent dots or other shapes painted directly onto a portion of the sight. This latter arrangement often compromises the visibility of the sight under bright light conditions.

The present invention is directed to overcoming the problems set forth above. It is desirable to have a sight for weapons that is readily visible in the brightness of day or the darkness of night. It is also desirable to have such a sight that is easy to see and hold in a user's line of vision while aligning the weapon with a target. Furthermore, it is desirable to have such a weapon sight that does not require a powered light source.

SUMMARY OF THE INVENTION

In accordance with one aspect of the present invention, a weapon sight includes an elongated optical fiber formed of a light-gathering, fluorescent plastic material. The elongated optical fiber has a first end in which light is emitted to provide an aiming indicia, a second end spaced from the first end, and an outer surface extending between the first and second ends. The weapon sight further includes a holder, attachable to the weapon, that is adapted to support the elongated optical fiber. The weapon sight further includes a phosphorescent, light-emitting member disposed at a position adjacent the elongated optical fiber.

Other features of the weapon sight embodying the present invention include the phosphorescent, light-emitting member being positioned elevationally below the elongated optical fiber when the holder is mounted on the weapon. Still other features include the light-emitting member being shaped to form an elongated strip having a surface aligned in parallel relationship with the elongated optical fiber. In other embodiments, the light-emitting member alternatively has a flat planar surface, or an angled or contoured surface adapted to focus light onto the outer cylindrical surface of the elongated optical fiber. The phosphorescent, light-emitting member may include a film formed of phosphorescent paint, a plastic material containing luminescent pigment, or a light-emitting radioactive material. Yet other features of the weapons sight embodying the present invention include the light-emitting member additionally or solely being disposed adjacent a transverse end wall of the elongated fiber at the second end of the fiber. Also, the elongated strip embodiment of the light-emitting member may be in the form of a replaceable insert. Still other embodiments of the weapon sight include the light-emitting member having a body shaped to define a screw having an outer surface defining screw threads adapted to mate with screw threads formed in a portion of the holder, and an end face having a light-emitting material deposited thereon. In this arrangement, the screw-shaped body of the elongated light-emitting member is disposed in coaxial alignment with the elongated optical fiber.

In accordance with another aspect of the present invention, a weapons sight includes an elongated optical fiber formed of a light-gathering fluorescent plastic material and a holder attachable to a weapon and adapted to support the elongated optical fiber. The weapons sight further includes an elongated light-reflecting member disposed at a position adjacent the elongated optical fiber.

Other features of the weapon sight embodying the present invention include the light-reflecting member comprising a film formed of light-reflective paint or a solid insert having a light-reflective surface. The light-reflective surface may either be a flat planar surface aligned in parallel relationship with the elongated optical fiber or a contoured surface adapted to focus reflected light onto an outer cylindrical surface of the elongated optical fiber.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
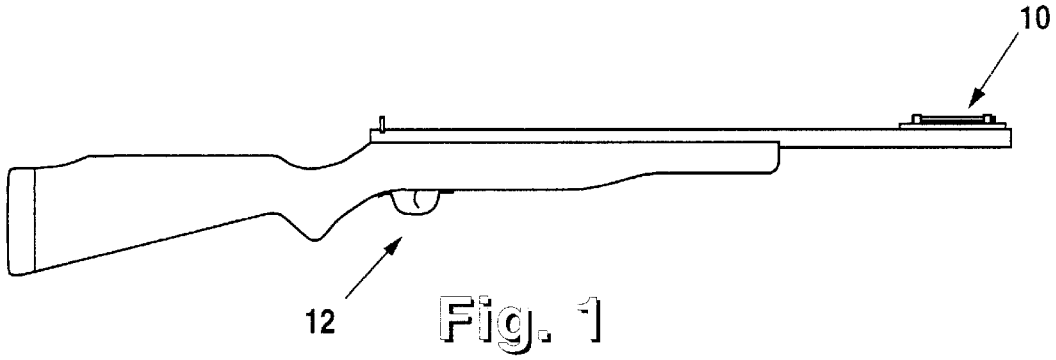
FIG. 1 is an elevational view of a rifle having a front sight embodying the present invention.
Figure 2:
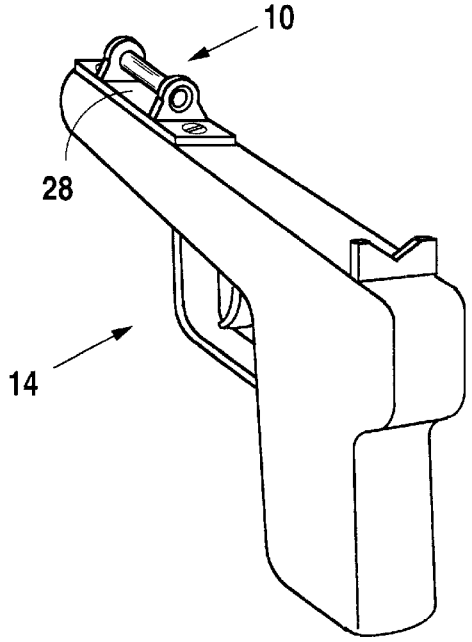
FIG. 2 is a three-dimensional view of a handgun having a front sight embodying the present invention.
Figure 3:
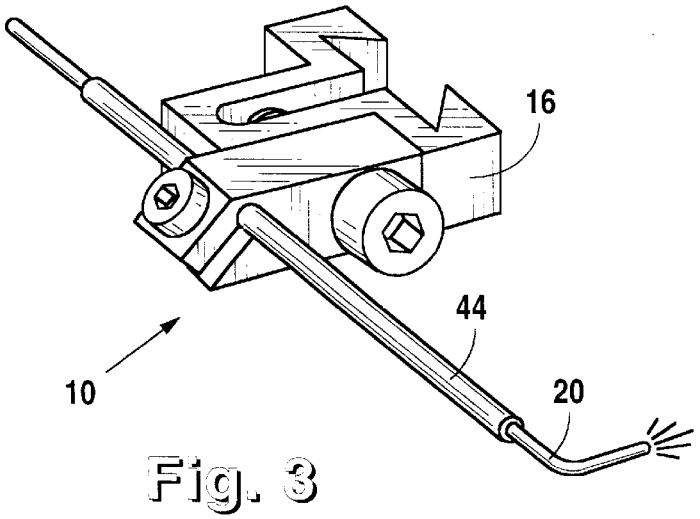
FIG. 3 is a three-dimensional view of a sight pin and adapter embodying the present invention, arranged for mounting in a dovetail bracket attachable to a bow.

A weapon sight 10 embodying the present invention is adaptable for use on a multitude of weapons such as a rifle 12 as shown in FIG. 1, a handgun 14 as shown in FIG. 2, or mountable in a bracket 16 attachable to a bow as shown in FIG. 3. The term "weapon" as used herein and in the claims means weapons used in military, law enforcement, hunting, recreational or other applications, including toy weapons. Thus, the weapon sight 10, provides an aiming indicia for any such weapon. In the preferred embodiments the sight 10 is mountable in a holder 18 as shown in FIGS. 4–8, or alternatively in a tubular holder 42 as shown in FIGS. 3 and 9–12.

In all of the below-described embodiments, the sight 10 includes an elongated optical fiber 20 formed of a light-gathering fluorescent plastic material. Such fibers are formed of fluorescent dye polymers having a diameter of approximately 0.030 inches (0.08 mm), and typically range from about 0.020 inches (0.05 mm) to about 0.080 inches (0.20 mm), and are capable of gathering light through the external cylindrical surface along the length of the fiber to conduct and focus gathered light at the transverse end surfaces. In the present embodiments, the elongated optical fiber 20 has a first end 22 at which light is emitted to provide a weapon user's aim point indicia, and a second end 24 spaced from the first end 22 which, in certain embodiments, also acts as a light-gathering surface. The light-gathering outer surface of the elongated optical fiber 20 extends between the first and second ends 22, 24 of the fiber 20. The ends 22,24 of the fiber 20 are typically flared to form a lens providing a larger dot source of emitted light or, alternatively, an enlarged light-gathering surface.

The holder 18 is adapted to support the elongated optical fiber 20, and may be either permanently attached to a weapon, or detachably connected to the weapon by screws extending through holes 26 at the ends of the holder 18 and into engagement with threaded holes provided in the barrel of the weapon. Other detachable mounting arrangements include attachment with a removable adhesive material such as double-sided tape or magnets. Also, the holder 18 may comprise an elongated protective tube by itself, or in conjunction with a bracket for other fixture attached to the weapon, e.g., the bracket 16 that is attachable to a bow as illustrated in FIG. 3.

Importantly, each arrangement of the sight 10 embodying the present invention includes a phosphorescent, light-emitting, or alternatively, a light-reflecting member which provides a source of illumination to the elongated optical fiber 20. The term "phosphorescent", as used herein and in the claims, means a material characterized by the ability to provide luminescence that persists after the removal of an exciting source which may include natural light, artificial light, and radioactive decay of materials producing radioluminescence. In the first embodiment shown in FIG. 4, an elongated, phosphorescent, light-emitting member 28 is disposed on the holder 18 at a position adjacent, and in substantially parallel relationship with, the elongated optical fiber 20. When the holder 18 is mounted on a weapon, the elongated light-emitting member 28 is positioned elevationally below the optical fiber 20.

Figure 4:
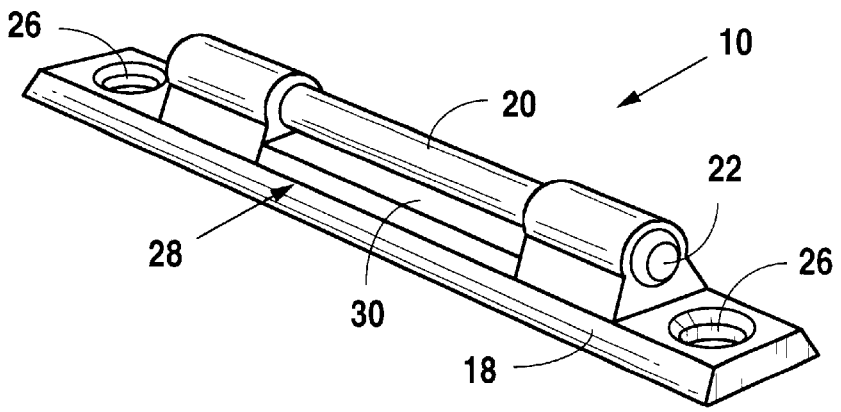
FIG. 4 is a three-dimensional view of a weapon sight embodying the present invention.

The phosphorescent, light-emitting member 28 is advantageously formed of a material containing phosphorescent, or long-afterglow, pigments. Long-afterglow pigments, such as LUMILUX® N-pigments, produced by Riedel-deHaën of Seeize, Germany, possess the property of emitting light while they are being excited and also for a long time thereafter. This phenomenon, as defined above, is known as phosphorescence, or afterglow, and can be perceived by a person whose eyes have become adapted to the darkness, even several hours after the source of excitation has been removed. Excitation and emission can be repeated indefinitely. Fatigue of the basic luminescent mechanism does not occur. Both daylight and white artificial light are suitable sources of excitation. These materials are typically used for the production of long-afterglow safety products such as warning, mandatory and escape route signs. Long-afterglow pigments are available as paints, epoxy fillers, plastic films, plastic plates, enamels, and molded plastic articles. In the present invention, the long-afterglow pigments may be incorporated in a paint or enamel applied directly to the surface of the holder 18 adjacent the elongated optical fiber 20 to form a film of the material 30, as shown in FIG. 4.

Figure 5:
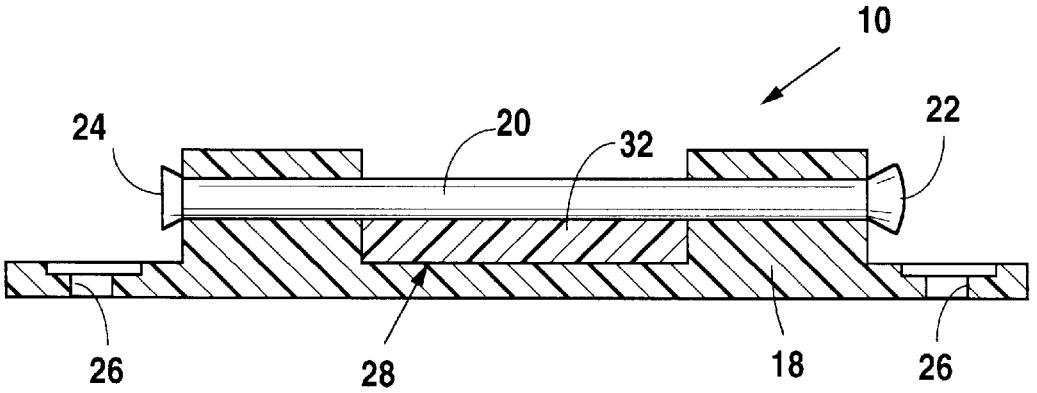
FIG. 5 is a longitudinal sectional view of a weapon sight embodying the present invention.
Figure 6:
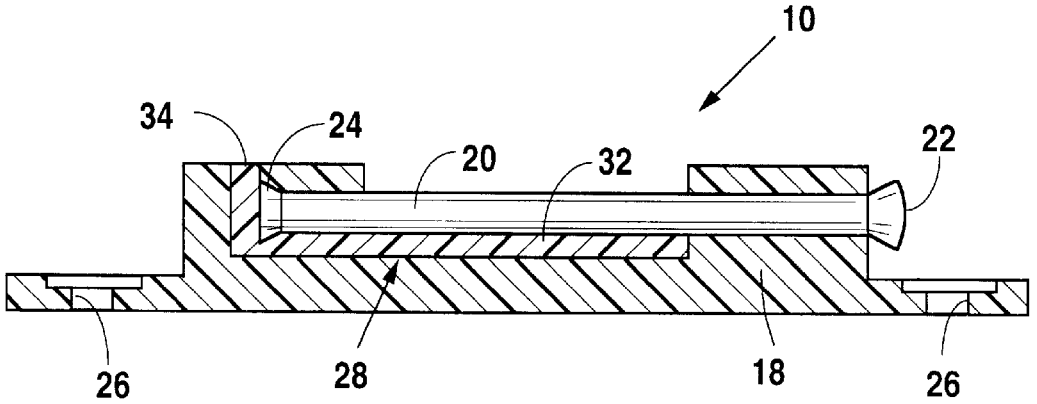
FIG. 6 is a longitudinal section view of another arrangement of the weapon sight embodying the present invention.
Figure 7:
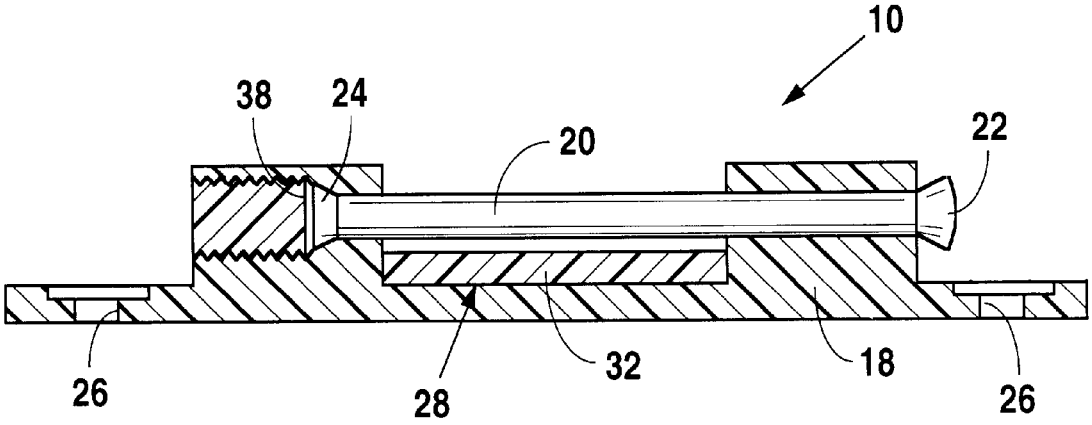
FIG. 7 is a longitudinal section view of still another arrangement of the weapon sight embodying the present invention.

Alternatively, the long-afterglow pigments may be incorporated in a phosphorescent molded plastic insert 32 disposed on the holder 18 at a position adjacent, and elevationally below the elongated optical fiber 20, as shown in FIGS. 5–7. When provided as a film 30 or molded insert 32, the light-emitting member 28 may be selectively replaceable. For example, the paint film 30 may be provided on an adhesive tape that is applied to the surface of a holder 18 or directly onto an underlying surface of the weapon itself. In a similar manner, the molded insert 32 may be shaped to snap into a recess provided in the upper surface of the holder 18.

Preferably, the light-emitting member 28, in whichever of the above-or below-described forms, is spectrally matched with the light absorption characteristics of the optical fiber 20, so that the wavelength of the emitted light is efficiently absorbed by the optical fiber 20. That is, the light-emitting member 28 generally has optimal light emission intensity within a defined wavelength range. Therefore, it is desirable that the optical fiber 20 have optimal light gathering characteristics that fall within the optimal light emission wavelength range of the light-emitting member 28. By matching the light-emitting and light-absorbing characteristics of the two components, 28,20, the intensity of light emitted at the end, or ends, of the fiber 20 will be enhanced. Furthermore, the elongated light-emitting member 28 may, with appropriated shielding, comprise a radioactive light-emitting source, such as tritium and similar radioluminescent materials.

In other arrangements, the elongated, phosphorescent, light-emitting member 28 may be used in cooperation with a phosphorescent surface provided at the second end 24 of the elongated optical fiber 20, as shown in FIGS. 6 and 7. In the FIG. 6 arrangement, the elongated phosphorescent member 28 extends beyond the second end 24 of the optical fiber 20 and has an upwardly extending portion 34 adjacent the transverse end wall defining the second end 24 of the fiber 20. Thus, in this arrangement, the phosphorescent member 28 not only provides a source of light along at least a portion of the length of the optical fiber 20, but also provides a source of light directed into the end wall at the second end 24 of the fiber 20.

In another arrangement, shown in FIG. 7, the sight 10 includes a phosphorescent, light-emitting member 36 that is disposed in the holder 18 at a position adjacent the second end 24 of the elongated optical fiber 20. The light-emitting member 36 is positioned to direct emitted light onto the transverse end wall at the second end 24 of the fiber 20. As shown in the drawing, the light-emitting member 36 may comprise a body, formed of a plastic material, that is shaped to form a screw having an outer surface defining screw threads adapted to mate with screw threads formed in the holder 24. In this arrangement, the end face of the light-emitting member 36 is coated with a phosphorescent or other light-emitting material, such as the above-described phosphorescent paint, plastic material containing luminescent pigment, or radioactive material such as tritium. In this arrangement, the light-emitting member 36 is disposed at the second end of the fiber 20 and may be used in conjunction with the previously described elongated-light-emitting member 28, as shown in FIG. 7, or alternatively by itself, as a sole source of light.

Figure 8:
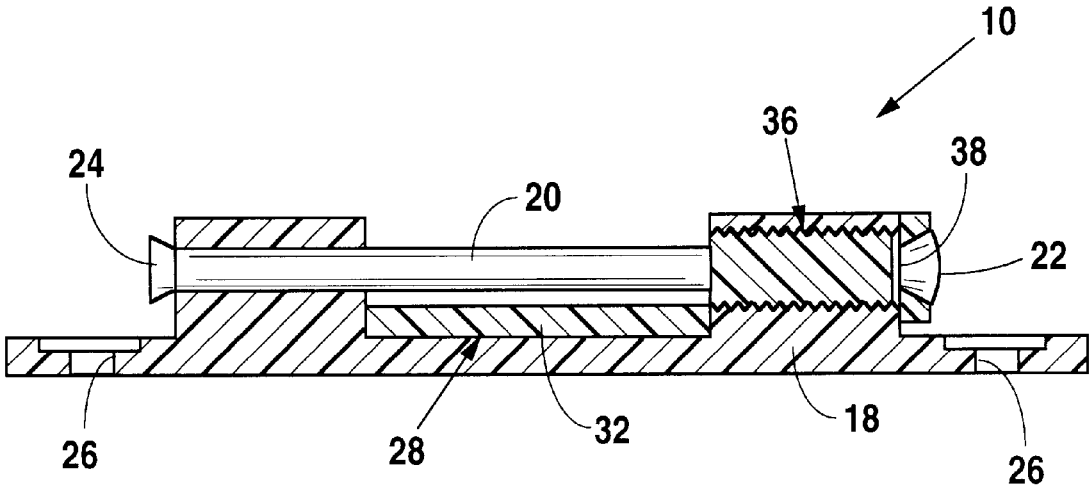
FIG. 8 is a longitudinal section view of yet another arrangement of the weapon sight embodying the present invention.

In yet another arrangement, shown in FIG. 8, the light-emitting member 36 has a body shaped to define a hollow screw with an internal bore adapted to mate with a portion of the outer cylindrical surface of the elongated optical fiber 20 and an outer surface that defines screw threads adapted to mate with screw threads formed in a portion of the holder 18. In this arrangement, the end face of the light-emitting member 36 is coated with a phosphorescent, light-emitting material such as the above-described phosphorescent paint, plastic material containing luminescent pigment, or radioactive material such as tritium, which emits light into a clear disk 40. The disk 40 directs light emitted from the member 36 onto the light-gathering outer surface of the optical fiber 20 at the first end 22 of the fiber 20. In this arrangement, both the light-emitting member 36 and the disk 40 are coaxially aligned with the elongated optical fiber 20. If desired, the coaxially aligned light-emitting member 36 may have a cross-sectional shape other than circular, for example, triangular, rectangular, octagonal or other shape.

Figure 9:
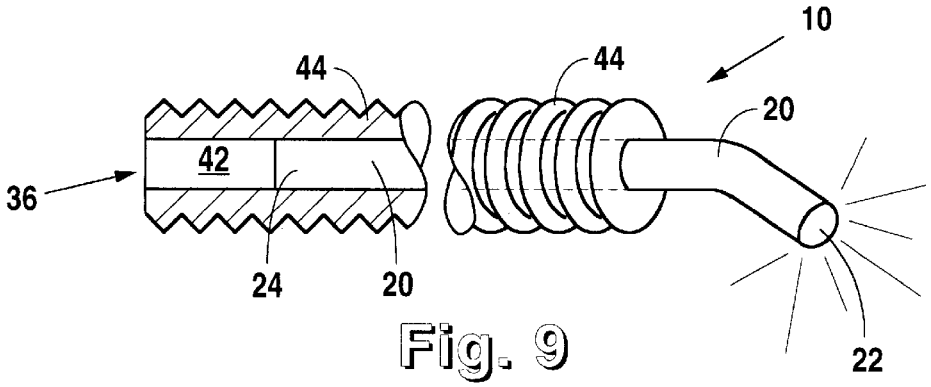
FIG. 9 is a partially sectioned view of the weapon sight embodying the present invention, adapted for mounting in a bracket attachable to a bow.
Figure 10:
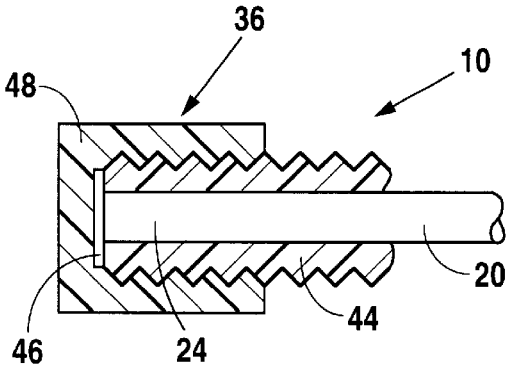
FIG. 10 is a partially sectioned view of one end of a weapon sight embodying the present invention, adapted for mounting on a bow.

In still other arrangements of the sight 10 embodying the present invention, the phosphorescent, light-emitting member 36 may comprise a small cylindrical capsule 42 of phosphorescent material, or radioactive material such as tritium, having a diameter substantially equal to that of the optical fiber 20. In this arrangement, the capsule 42 is protectively shielded by a tubular holder 44, as shown in FIG. 9 and is particularly suited for mounting in the bracket 16 which is attachable to a bow. Alternatively, the light-emitting member 36 may include a coating of phosphorescent or radioactive light-emitting material disposed on an internal recessed end face 46 of a cap 48, adapted to enclose the second end 24 of the optical fiber 20, as shown in FIG. 10.

Figure 11:
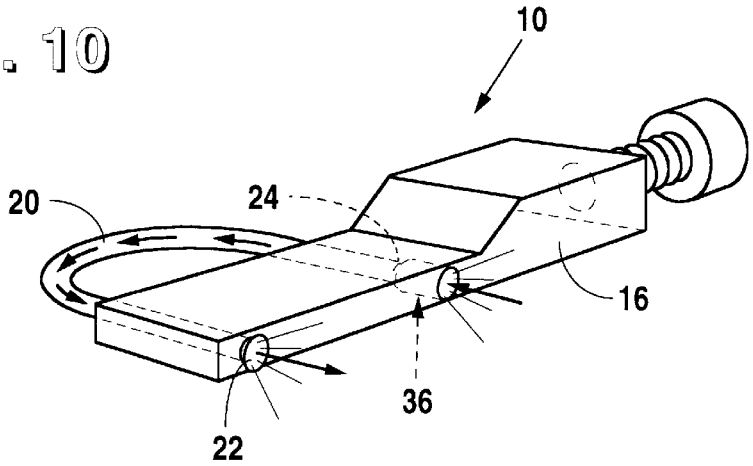
FIG. 11 is a three-dimensional view of another arrangement of the weapon sight embodying the present invention.
Figure 12:
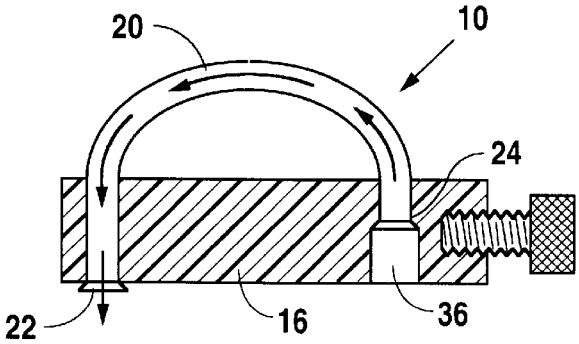
FIG. 12 is a planar sectional view of the weapon sight, embodying the present invention, shown in FIG. 11.

In yet another arrangement, the elongated optical fiber 20 may have a "U" shape, as shown in FIGS. 11 and 12. In this arrangement, a phosphorescent, light-emitting source may be disposed at the second end 24 of the fiber 20 which forms the base of one leg of the "U", with the light-emitting first end 22 of the fiber 20 forming the base of the other leg of the "U". The "U" arrangement provides a significantly increased exposed length of outer surface area of the fiber 20 to enhance the light-gathering characteristics of the sight 10, and is particularly suitable for use as a bow sight.

Alternatively, the light-emitting member 28 of the weapon sight 10 may comprise an elongated member disposed on the holder 18 at a position adjacent the elongated optical fiber 20 that emits reflected light. For example, the film of paint 30 or the molded insert 32, as shown in FIGS. 4–6, may simply have a light-reflective surface rather than a luminescent, phosphorescent, or radioluminescent surface. Although not as effective in conditions of absolute darkness, a light-reflective surface is effective in directing small amounts of light, such as bright moonlight or starlight on a clear night, to the light-gathering exterior wall of the elongated optical fiber 20. A suitable light-reflective surface may be advantageously provided by a strip of white material, such as paint, enamel or tape, or by a highly reflective polished or mirrored surface on the holder or the weapon.

In the above-described arrangements, i.e. either as a light-emitting surface or as a light-reflecting surface, the elongated member disposed elevationally below the optical fiber 20 may have a flat planar surface, or an angled or contoured surface shaped to direct or focus light onto the cylindrical light-gathering surface of the elongated optical fiber 20.

If desired, the holders 18,44 in either the gun or bow application arrangements, may be formed of a clear plastic material to increase the surface area of the optical fiber 20 exposed to available light. Alternatively, the holder 18, particularly in the gun application arrangements shown in FIGS. 1, 2, and 4–8, may have a slotted opening at the top which may be spread to permit insertion of the fiber 20 into the fiber-receiving bore. In yet another arrangement, the holder 44, adapted for use on a bow as shown in FIGS. 3, and 9–12, may have a phosphorescent or light-reflective surface provided on either the internal bore or outer surface of the tubular holder 44, in the form of a strip positioned elevationally below the optical fiber 20 when the holder 44 is inserted in the bracket 16 and mounted on a bow. It should also be noted that the elongated light-emitting member 28, shown in FIGS. 4–7, may be formed of an encapsulated radioactive material such as tritium.

Figure 13:
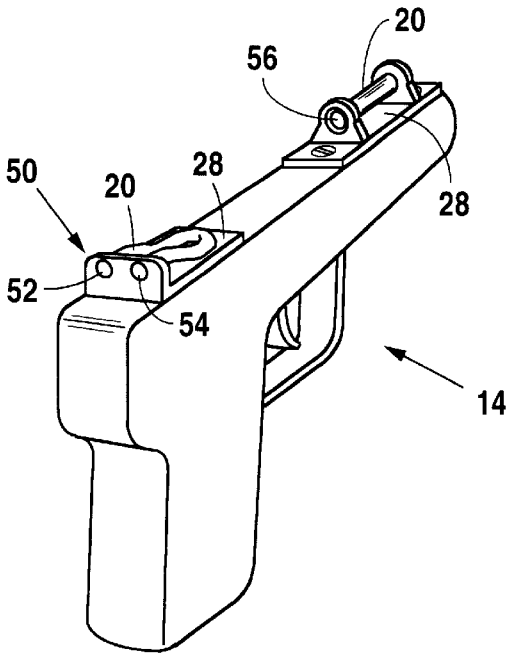
FIG. 13 is a three-dimensional view of a handgun having a U-shaped rear sight in combination with a front sight, both of which embody the present invention.
Figure 14:
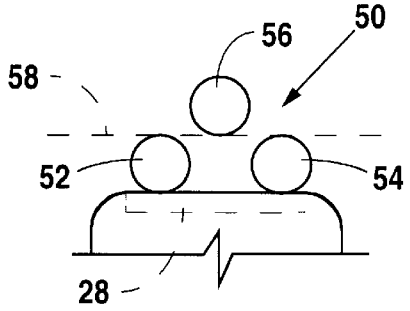
FIG. 14 is a rear view of the handgun sight arrangement shown in FIG. 13, with the gun properly aligned with the front sight laterally positioned between the rear sight dots.

The weapon sight 10 embodying the present invention, is also applicable to a rear sight of a gun, either singly or in combination with a front sight, or to multiple sights on a bow. For example as shown in FIG. 13, a handgun 14 may have an optical fiber 50 arranged in a U-shape providing two spaced-apart horizontally aligned dots 52, 54 as a rear sight, and an elongated optical fiber 20 providing a single dot 56 front sight. As described above, both sights 50,20 have a light-emitting member 28 disposed at a position adjacent the respective fibers 50,20 to provide illumination of the respective end faces 52,54,56 under dark or low-light conditions. As shown in FIG. 14, when properly aligned, the dot 56 provided by the front sight 20 is laterally positioned midway between the two dots 52,54 at the end of the U in the rear sight 50, with the bottom of the front dot 56 elevationally aligned with a line 58 extending across the top of the rear sight dots 52,54. Desirably, for ease of identification and alignment, the front sight 56 and the rear sights 52,56 may be formed with optical fibers having different wavelength emission properties, e.g. red and green. Also, if desired, the U-shaped rear fiber 50 may be curved or mounted at an angle such that the bottom portion of the U does not block observation of the front sight 28, thereby permitting horizontal alignment of the three dots 52,54,56 as an aiming indicia.

It should also be noted that the elongated optical fiber may be arranged in a modified U-shape in which one leg of the U is shortened to form a J-shape wherein either one or both ends of the fiber are positioned to provide an illuminated dot, generally as a front sight as described in the aforementioned copending U.S. application Ser. No. 08/506,722. The above-described arrangements of the light-emitting member 28 may also be used in combination with such J-shaped light-gathering optical fiber sight structures.

Figure 15:
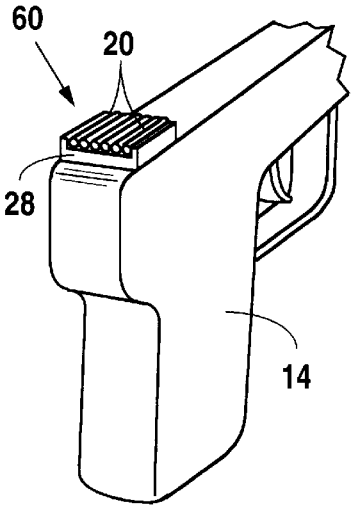
FIG. 15 is a fragmentary three-dimensional view of another arrangement of a weapon sight embodying the present invention, showing a row of fibers aligned side-by-side in a planar array to provide an elongated sight line.
Figure 16:
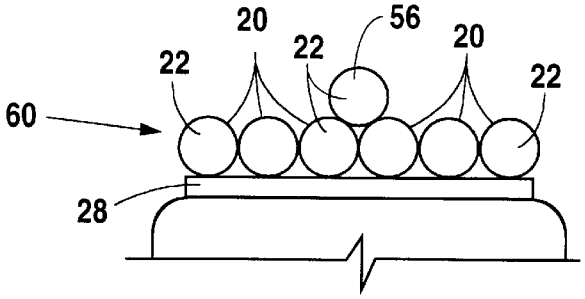
FIG. 16 is a rear view of a gun having a rear sight as shown in FIG. 15, and a front sight, both of which embody the present invention, when the gun is properly aligned elevationally and laterally, with the front sight dot centered on the elongated sight line at the mid-point of the line.

Also, a row of fibers 20, aligned side-by-side in a planar array 60, as shown in FIG. 15, forms a row of dots which provide an elongated sight line. The row of fibers 20 may be arranged in either a horizontal or vertical orientation, and may be used in either a front sight, a rear sight, or both. When provided with a light-emitting or light reflecting member 28, 36 positioned below or at one end of the planar array 60, a bright horizontal line is produced under low light or dark conditions. The planar array 60 rear sight may be used in conjunction with the elongated fiber 20 front sight described above. In this arrangement, when the gun is properly aligned elevationally and laterally, the front sight dot 56 is centered on the horizontal sight line provided by the planar array 60 at the mid-point of the array 60, as illustrated in FIG. 16.

Moreover, the above-described light-emitting materials, i.e. phosphorescent paint, plastic containing luminescent pigments, or radioluminescent light source, may be applied directly to a portion of the optical fiber 20. For example, the light-emitting material may be applied as a coating on one-half of the circumference of the fiber along its length, or completely around the fiber over only a portion of its length.

Thus, it can be seen that the weapon sight 10 embodying the present invention is readily usable as an aiming indicia for a weapon in either bright daylight, nighttime, or in any lighting condition between the two. In the daytime, the light-gathering fluorescent optical fiber 20 provides a bright dot at the first end 22 of the fiber 20 that is instantly observable and provides a bright dot light source for use as an aiming indicia against virtually any background. Under low light and dark conditions, the light-emitting or light-reflective member, disposed elevationally below or in coaxial alignment with the optical fiber 20, serves to illuminate the optical fiber 20 to produce a bright dot at the first end 22 of the fiber 20 that is readily identifiable under the low light or dark ambient conditions.

Although the present invention is directed in terms of preferred exemplary embodiment, with specific illustrative key constructions and arrangements, those skilled in the art will recognize that changes in those arrangements and constructions, and in the specifically identified materials, may be made without departing from the spirit of the invention. For example, the construction of the holder 18 may be modified to accommodate specific weapon or use requirements. Such changes are intended to fall within the scope of the following claims. Other aspects, features, and advantages of the present invention may be obtained from a study of this disclosure and the drawings, along with the appended claims.

What I claim is:

1. A sight for a weapon, comprising:

an elongated optical fiber formed of a light-gathering fluorescent plastic material and having a first end a which light is emitted to directly provide an aiming indicia, at second end spaced from said first end, and an outer surface extending between said first and second ends;

a holder adapted to support said elongated optical fibre, said holder being attachable to said weapon; and a phosphorescent, light-emitting member disposed at a position adjacent said elongated optical fiber whereby light emitted from said light-emitting member is gathered by at least said outer surface extending between the first and second ends of the elongated optical fiber.

2. A sight for a weapon, as set forth in claim 1, wherein said elongated, phosphorescent, light-emitting member is disposed on said holder at a position elevationally below said elongated optical fiber when said holder is mounted on said weapon.

3. A sight for a weapon, as set forth in claim 2, wherein said elongated, phosphorescent, light-emitting member is disposed in abutting contacting relationship with at least a portion of elongated optical fiber.

4. A sight for a weapon, as set forth in claim 1, wherein said elongated, phosphorescent, light-emitting member is shaped to form a strip having a flat planar surface aligned in parallel relationship with said elongated optical fiber.

5. A sight for a weapon, comprising:

an elongated optical fiber formed of a light-gathering fluorescent plastic material and having a first end a which light is emitted to provide an aiming indicia, at second end spaced from said first end, and an outer surface extending between said first and second ends;

a holder adapted to support said elongated optical fibre said holder being attachable to said weapon; and an elongated, phosphorescent, light-emitting member disposed at a position adjacent said elongated optical fiber which is comprised of a film formed of phosphorescent paint.

6. A sight for a weapon, as set forth in claim 1, wherein said elongated, phosphorescent, light-emitting member comprises a plastic material containing luminescent pigment.

7. A sight for a weapon, as set forth in claim 1, wherein said elongated, phosphorescent, light-emitting member is selectively replaceable.

8. A sight for a weapon, as set forth in claim 1, wherein said elongated, phosphorescent, light-emitting member comprises a light-emitting radioactive material.

9. A sight for a weapon, as set forth in claim 8, wherein said radioactive material is tritium.

10. A sight for a weapon, as set forth in claim 1, wherein said light-emitting member has optimal light emission intensity within a defined wavelength range and said optical fiber has defined optimal light gathering characteristics within the defined optimal light emission wavelength range of said light-emitting member.

* * * * *